US009062574B2

(12) United States Patent
Wiemann et al.

(10) Patent No.: US 9,062,574 B2
(45) Date of Patent: Jun. 23, 2015

(54) DEVICE FOR ACTUATING TWO OUTLET VALVES, WHICH ARE ACTED ON VIA A VALVE BRIDGE, OF A VALVE-CONTROLLED INTERNAL COMBUSTION ENGINE

(71) Applicant: MAN Truck & Bus AG, Munich (DE)

(72) Inventors: Robert Wiemann, Schwabach (DE); Georg Maget, Freystadt (DE)

(73) Assignee: MAN TRUCK & BUS AG, Munich (DE)

( * ) Notice: Subject to any disclaimer, the term of this patent is extended or adjusted under 35 U.S.C. 154(b) by 0 days.

(21) Appl. No.: 14/267,260

(22) Filed: May 1, 2014

(65) Prior Publication Data

US 2014/0326203 A1 Nov. 6, 2014

(30) Foreign Application Priority Data

May 2, 2013 (DE) ..... 10 2013 007 468

(51) Int. Cl.

| | |
|---|---|
| ***F01L 9/02*** | (2006.01) |
| ***F01L 13/06*** | (2006.01) |
| ***F01L 1/18*** | (2006.01) |
| ***F01L 1/26*** | (2006.01) |

(52) U.S. Cl.

CPC ..... *F01L 13/06* (2013.01); *F01L 1/181* (2013.01); *F01L 1/26* (2013.01); *F01L 13/065* (2013.01)

(58) Field of Classification Search

CPC ..... F01L 13/06; F01L 13/065; F01L 9/02; F01L 1/34403; F01L 1/185; F01L 13/0063; F01L 13/0021; F01L 2013/0068; F01L 2013/0073

USPC ..... 123/90.12, 90.16, 320, 321

See application file for complete search history.

(56) References Cited

U.S. PATENT DOCUMENTS

| | | | | |
|---|---|---|---|---|
| 8,225,769 | B2 * | 7/2012 | Dilly | 123/321 |
| 2005/0087170 | A1 * | 4/2005 | Rammer et al. | 123/321 |
| 2007/0144472 | A1 * | 6/2007 | Yang | 123/90.16 |
| 2010/0006063 | A1 * | 1/2010 | Dilly | 123/347 |
| 2010/0319657 | A1 * | 12/2010 | Dodi et al. | 123/321 |
| 2011/0079196 | A1 * | 4/2011 | Kraft et al. | 123/321 |
| 2011/0220062 | A1 * | 9/2011 | Sailer et al. | 123/321 |

FOREIGN PATENT DOCUMENTS

DE 10 2008 061 412 A1 1/2010

* cited by examiner

*Primary Examiner* — Thomas Denion
*Assistant Examiner* — Daniel Bernstein
(74) *Attorney, Agent, or Firm* — Lucas & Mercanti, LLP

(57) ABSTRACT

A device for actuating outlet valves that are acted on via a valve bridge of a valve-controlled internal combustion engine for motor vehicles includes a first piston-cylinder unit in the force flow between a cam of a driving camshaft and one of the outlet valves. When one of the outlet valves opens under the action of exhaust-gas counterpressure, play compensation in the valve drive can be produced in order to hold the one of the outlet valves open by the first piston-cylinder unit. A second, coaxial piston-cylinder unit interacts with a positionally fixed counter bracket and controls a discharge duct out of the pressure chambers of the two piston-cylinder units. The piston of the first piston-cylinder unit is preloaded in a readjustment direction by a spring. To reliably obtain a lack of play in the valve drive in particular during engine braking operation, the readjustment spring acts, without being supported in the valve bridge, on the pistons of both piston-cylinder units.

9 Claims, 4 Drawing Sheets

Abutment Counter bracket
14
7
3
2
21
KZE2
KZE1
16
16b
15b, 7b
15
Valve lift
1
TDC
BDC Abutment Counter bracket
Abutment Counter bracket
Abutment Counter bracket
TDC
BDC
Valve lift
KZE1
KZE2
14
16
7
3
2
15
21
22
23
7b
15b
16b
15b, 7b

DEVICE FOR ACTUATING TWO OUTLET VALVES, WHICH ARE ACTED ON VIA A VALVE BRIDGE, OF A VALVE-CONTROLLED INTERNAL COMBUSTION ENGINE

CROSS-REFERENCE TO RELATED APPLICATIONS

This application claims the priority of DE 10 2013 007 468.1 filed May 2, 2013, which is incorporated by reference herein.

BACKGROUND OF THE INVENTION

The present invention relates to a device for actuating two outlet valves, which are acted on via a valve bridge, of a valve-controlled internal combustion engine for motor vehicles.

From US 2010/319657 A1, for example, it is known for the braking action of an internal combustion engine in the overrun mode to be intensified by virtue of the exhaust-gas backpressure having a decompression action superposed thereon by a pressure flap in the exhaust tract (EVB or exhaust valve brake), wherein at least one outlet valve per cylinder of the internal combustion engine is held open in an intermediate position in the braking mode. This is realized in the valve drive of the internal combustion engine by a hydraulically charged piston-cylinder unit in the force flow between the driving cam of the camshaft and the actuation element which acts on the outlet valve, or a rocker arm. There is also arranged in the actuation element a second piston-cylinder unit which acts as a hydraulic valve play compensation element (HVA) such as is known per se.

Furthermore, from DE 10 2008 061 412 A1, a generic device is known in which two outlet valves per cylinder of the internal combustion engine are actuated by means of a valve bridge, wherein, by means of two hydraulically charged piston-cylinder units in conjunction with a positionally fixed counter bracket, one of the two outlet valves is held open during engine braking operation. Furthermore, a hydraulic valve play compensation element (HVA) is provided which ensures play-free valve actuation during normal engine operation.

BRIEF SUMMARY OF THE INVENTION

It is an object of the invention to provide a device for actuating two outlet valves, using structurally simple means, such that a functionally reliable and fault-free valve drive, preferably in conjunction with an HVA, can be realized both during normal operation and also in the engine braking or EVB mode.

It is proposed according to the invention that a spring, which in the EVB function acts in a readjustment direction, acts on the pistons of both piston-cylinder units (hereinafter referred to for short as KZE) without being supported on the valve bridge. It has been found that, by means of this structurally simple measure, aside from dispensing with a second spring for KZE2, it is possible in the dynamic course of the valve actuation in the EVB function to realize faster reaction times and more precise functioning of the discharge or outflow duct in interaction with the positionally fixed counter bracket. The non-spring-loaded valve bridge makes it possible to realize less idle travel in the system, faster closure of the outflow duct, and as a result, less wear of the components. The use of a hydraulic valve play compensation element (HVA) incorporated into the valve drive also gives rise to the advantage that said readjustment spring does not act via the valve bridge against the readjustment spring provided in a known manner in the HVA, and thus cannot counteract a lack of play in the valve drive, and permits permanent, play-free valve actuation.

In a particularly simple manner from a manufacturing aspect, the cylinder chambers of KZE1 and KZE2 may be connected to one another via a recess or bore in the valve bridge, through which recess or bore the spring, which is designed preferably as a helical compression spring, extends so as to be supported on the pistons.

Furthermore, the pistons of KZE1 and of KZE2 may be guided in the corresponding cylinder bores by delimiting stops which permit readjustment movements, that is to say said pistons can deploy only over defined readjustment strokes which firstly prevent inadmissible valve play in EVB operation and secondly produce a targeted interaction with the counter bracket that controls the outflow duct, in order to ensure a reliable transition from EVB operation back into combustion operation.

In this regard, it may furthermore be provided that a pressure discharge duct is arranged in the cylinder of KZE1, which pressure discharge duct is open when the piston is retracted (combustion operation) and is closed when the piston is deployed (braking operation). Finally, as already mentioned above, a hydraulic valve play compensation element (HVA) may be provided in the force flow between the cam of the camshaft and the valve bridge. The HVA may be installed in the valve bridge, in a rocker arm that actuates said valve bridge, or at some other point in the force flow between the driving cam of a camshaft and the outlet valves. Here, it is particularly preferably possible for the piston-cylinder units KZE1 and KZE2 and the HVA to be supplied with pressurized oil jointly from a forced-circulation lubricating oil system of the internal combustion engine, wherein in each case one pressure-maintaining check valve is arranged in the feed line to the piston-cylinder units KZE1 and KZE2 and in the HVA.

BRIEF DESCRIPTION OF THE DRAWINGS

An exemplary embodiment of the invention will be explained in more detail below. In the schematic drawing.

DETAILED DESCRIPTION OF THE PREFERRED EMBODIMENTS

Figure 1:
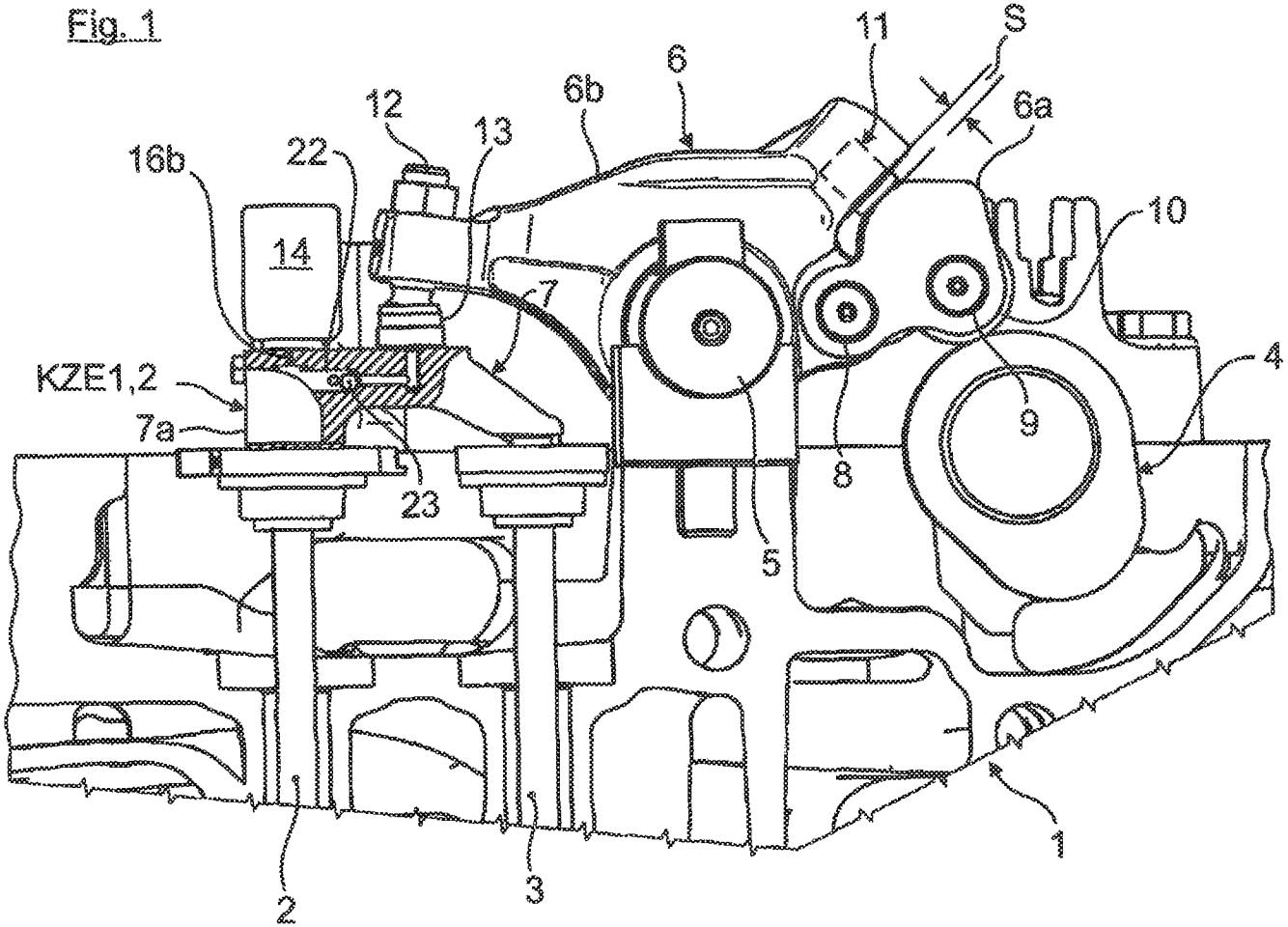
FIG. 1 shows a partial cross section through a cylinder head of a valve-controlled reciprocating-piston internal combustion engine for motor vehicles with two outlet valves per cylinder, which outlet valves are driven by a cam of the camshaft of the internal combustion engine via a two-part rocker arm and a valve bridge, wherein two piston-cylinder units for providing an EVB function and a piston-cylinder unit as an HVA element are integrated into the valve drive.

FIG. 1 illustrates, only to the extent necessary for the understanding of the present invention, a cylinder head 1 of a valve-controlled four-stroke reciprocating-piston internal combustion engine (diesel engine) in which, in addition to the inlet valves (not visible), two outlet valves 2, 3 (only the valve shanks are illustrated) are guided in a displaceable manner. The valve springs that hold the valves 2, 3 closed in a known manner are not shown.

The valve drive that acts on the outlet valves 2, 3 is composed of a driving cam 4 of a camshaft of the internal combustion engine 1, a rocker arm 6 mounted on a fixed rocker arm axle 5, and a valve bridge 7 which extends over and acts on the two outlet valves 2, 3.

The functionally two-armed rocker arm 6 is of two-part form, with a cam lever 6*a* and with an actuating lever 6*b* which acts on the valve bridge 7, said cam lever and actuating lever projecting to both sides from the mounting point on the rocker arm axle 5.

The cam lever 6*a* is mounted on the actuating lever 6*b* by means of a separate pivot axle 8 and bears a roller 10 which is rotatably mounted on an axle 9 and which runs against the cam 4 for driving the rocker arm 6.

Between the cam lever 6*a* and the actuating lever 6*b*, and outside the pivot axle 8, there is arranged a hydraulic valve play compensation element (HVA) 11 which, in a known way, is composed of a hydraulically charged piston-cylinder unit with an integrated readjustment spring and a check valve and which keeps the valve drive free from play over a readjustment travel s.

The actuating lever 6*b* of the rocker arm 6 acts, via an adjusting screw 12 (with lock nut) and a connecting tappet 13 mounted thereon by spherical means, on the valve bridge 7 at a point located between the two outlet valves 2, 3.

Furthermore, above the valve bridge 7, there is provided a positionally fixed counter bracket 14 which interacts with the valve bridge 7 and the function of which will be explained in more detail.

Figure 2:
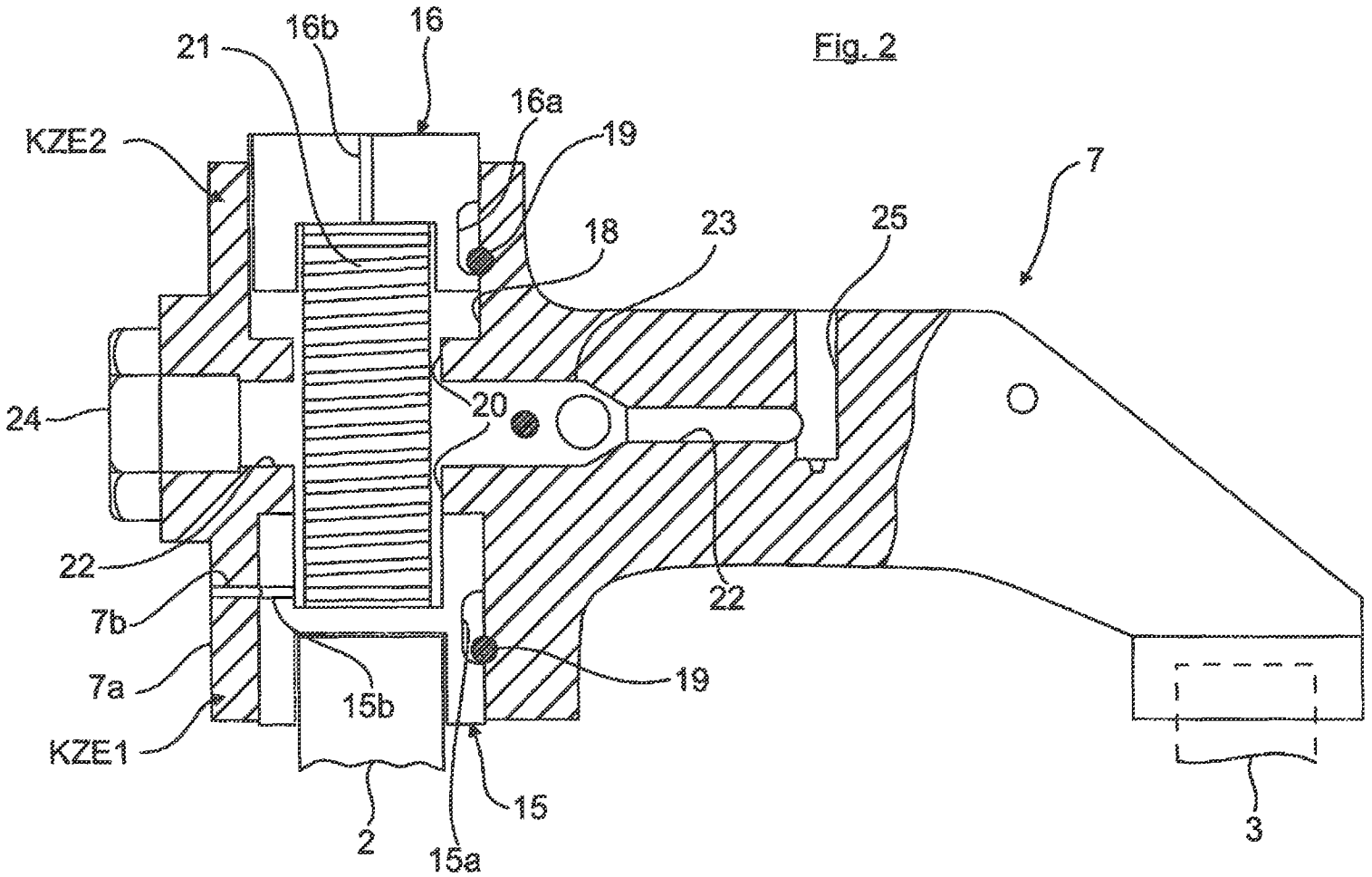
FIG. 2 shows, in an enlarged illustration, the valve bridge of FIG. 1 with the two integrated piston-cylinder units KZE1 and KZE2 and the common helical compression readjustment spring.

Within the valve bridge 7 there are arranged two piston-cylinder units KZE1 and KZE2 (FIG. 2) which have, in a coaxial alignment, two pistons 15, 16 which are guided in a displaceable manner in each case in cylinder bores 17, 18 and which delimit corresponding cylinder chambers within the valve bridge 7.

The pistons 15, 16 are provided, on their outer circumferential surfaces, with axially parallel cutouts 15*a*, 16*a* which, in conjunction with positionally fixed pins 19 extending transversely with respect thereto, form defined deployment limiters for the pistons 15, 16.

The cylinder chambers formed so as to be situated in each case below the pistons 15, 16 are connected to one another via an axially parallel bore 20, wherein said bore 20 has inserted therein a continuous helical compression readjustment spring 21 which exerts load on the two pistons 15, 16 in the outward direction, without being supported on the valve bridge 7. The spring 21 within the valve bridge 7 thus acts with different preload on the pistons 15, 16 in the case of changed piston positions, as will be explained in more detail on the basis of FIGS. 3 and 4.

The cylinder chambers below the pistons 15, 16 are furthermore connected via a central feed bore 22 to the forced-circulation lubricating oil system of the internal combustion engine, wherein a check valve 23 is incorporated into the feed bore 22. The feed bore 22 is at one side sealingly closed off by means of a screw 24, and at the other side issues via a branch duct 25 into the connecting tappet 13 and is connected via ducts (not illustrated in any more detail) in the connecting tappet 13, in the adjusting screw 12, in the rocker arm 6 and finally via the rocker arm axle 5 to the forced-circulation lubricating oil system of the internal combustion engine. It is self-evident that further ducts for the lubrication of the moving parts of the valve drive and for the supply of pressurized oil to the HVA 11 are also provided in the rocker arm 6.

In the piston 16 of KZE2 there is provided an outflow bore 16*b* of defined cross section, which outflow bore interacts with the counter bracket 14 and issues into the common cylinder chamber, situated therebelow, of KZE1, KZE2; when the piston 16 bears against the counter bracket 14, the outflow bore 16*b* is thus closed.

Furthermore, in the piston 15 of KZE1 and in the corresponding cylinder wall 7*a* of the valve bridge 7, there are provided discharge ducts 15*b*, 7*b* of defined cross section, which discharge ducts, when the piston 15 is retracted, are situated in axial alignment and, being open to the outside, can thus release pressure from the feed line 22. It is however alternatively also possible for a retraction of the piston 16 of KZE2 to be permitted when the valve bridge 7 travels upward toward the counter bracket 14; this may be necessary if, with the thermal expansion of the valves and progressive wear of the seat ring of the valves, the top dead centre of the valve bridge is displaced upward by approximately 0.4 to 0.8 mm. When the piston 15 is deployed, the discharge ducts 15*b*, 7*b* are, by contrast, offset with respect one another and closed.

The function of the valve drive or the valve bridge 7 will be explained in more detail on the basis of FIGS. 3*a* to 3*c* and FIGS. 4*a* to 4*c*. The upper position of the valve bridge 7 is denoted by the dashed line TDC (rocker arm roller 10 of the rocker arm 6 on the cam base circle) and BDC (largest valve lift in structural terms).

Figures 3A, 3B, 3C:
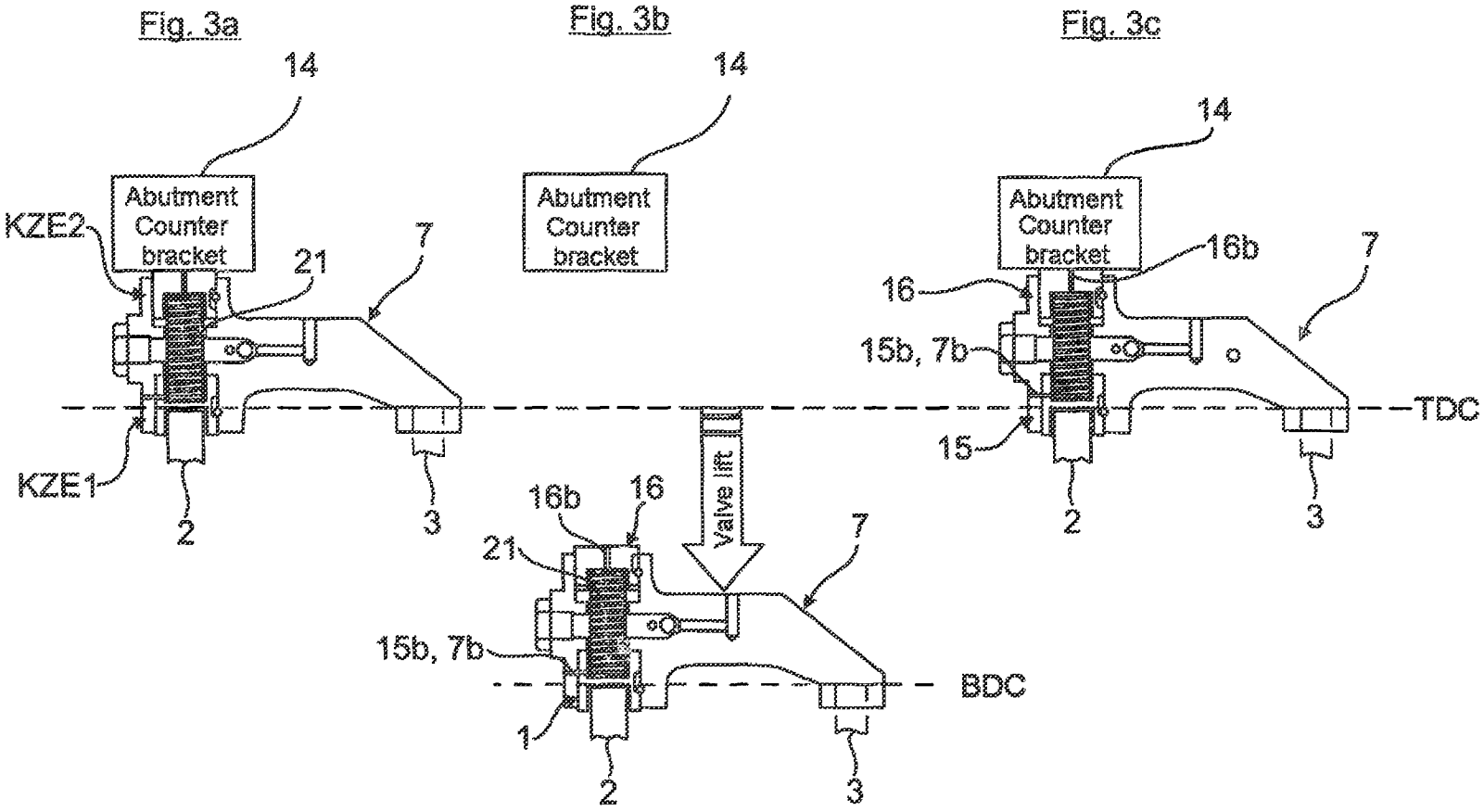
FIGS. 3*a* to 3*c* show the function of KZE1 and KZE2 in normal combustion operation.
Figures 4A, 4B, 4C:
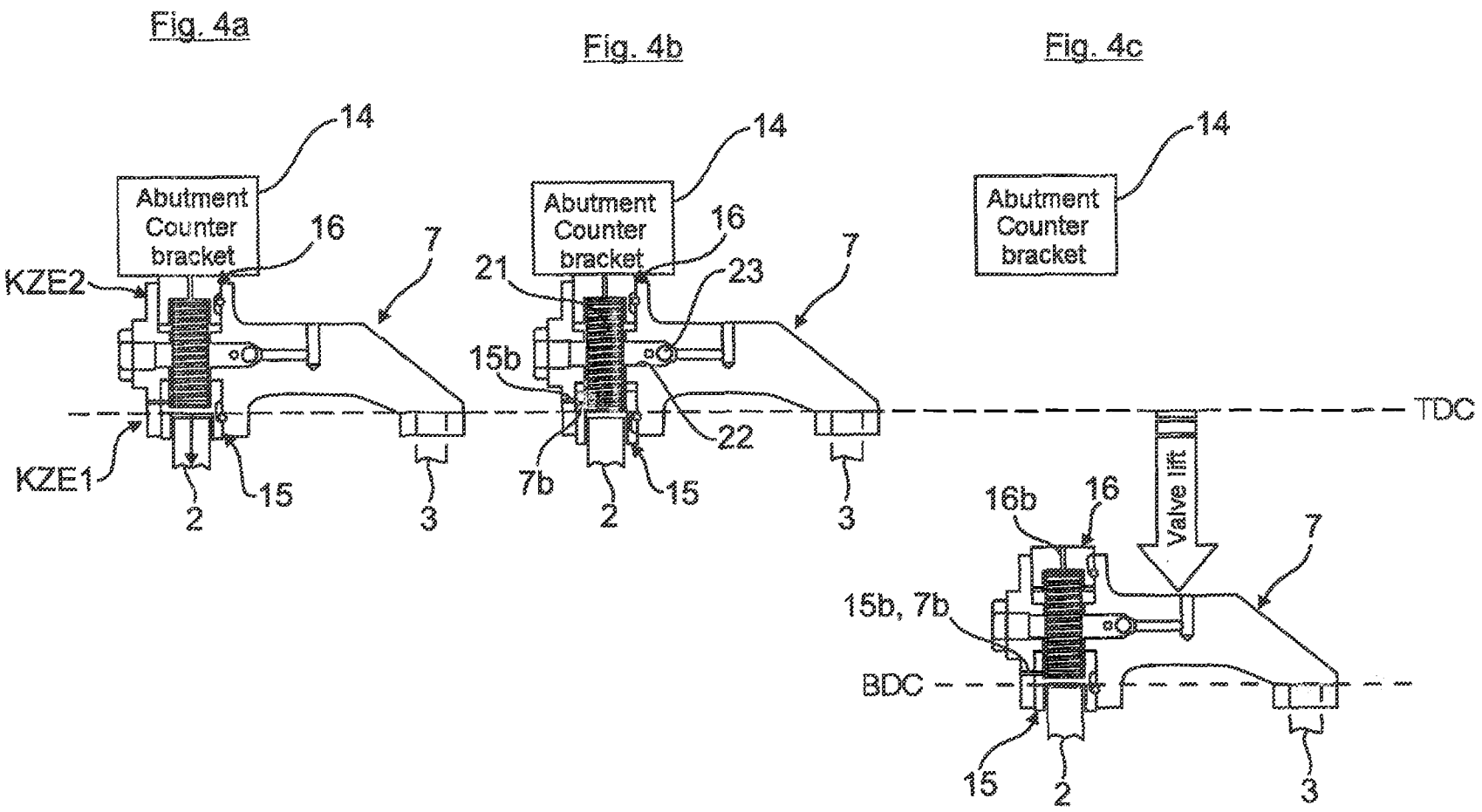
FIGS. 4*a* to 4*c* show the function of KZE1 and KZE2 during EVB operation of the internal combustion engine.

In normal engine operation (combustion operation), the valve bridge 7 acts on the outlet valves 2, 3 as per FIGS. 3*a* to 3*c*. Here, the HVA 11 can reliably compensate valve play in the valve drive because, as already stated above, the force of the readjustment spring 21 cannot impart a counteracting force, via the valve bridge 7, on the readjustment spring (not illustrated) of the HVA 11, and is supported only on the pistons 15, 16.

During the upward movement of the valve bridge 7, the piston 16 of KZE2 abuts against the counter bracket 14 shortly before TDC, whereby the outflow bore 16*b* is closed. During the abutment of the piston 16 when the valve bridge 7 is at TDC (FIG. 3*a* and FIG. 3*c*), the pressurized oil can be discharged out of the cylinder chambers of KZE1 and KZE2 via the discharge ducts 15*b*, 7*b*. Since no valve jump (or opening of the outlet valve 2 owing to the exhaust-gas back pressure) occurs during normal engine operation, the piston 15 of KZE1 does not deploy and the discharge ducts 15*b*, 7*b* are permanently open (cf. FIG. 3*b* with the valve bridge 7 in the BDC position).

During engine braking operation (FIGS. 4*a* to 4*c*) with the outlet valve 2 lifted to a defined extent owing to the exhaust-gas back pressure brought about in the exhaust system of the internal combustion engine, in the TDC position of the valve bridge 7 (FIG. 4*a*) the spacing between the valve bridge 7 and the counter bracket 14 is compensated by the piston 16 of KZE2, and the outflow bore 16*b* is kept closed.

When the outlet valve 2 is opened by the exhaust-gas back pressure (FIG. 4*b*), the piston 15 of KZE1 performs a follow-up movement under the force of the readjustment spring 21 so as to compensate the increasing valve play, such that the discharge ducts 15*b*, 7*b* are no longer in alignment and are accordingly closed. At the same time, oil is replenished by being drawn into the cylinder chambers below the pistons 15, 16 until, as a result of a minimal return oscillation of the outlet valve 2, the check valve 23 closes.

As a result, an oil pressure builds up in the valve bridge 7 between the pistons 15, 16, and the outlet valve 2 is held open.

When the rocker arm 6 actuates the valve bridge 7 (FIG. 4*c*) (outlet stroke), the piston 16 of KZE2 is moved away from the counter bracket 14 and the outflow bore 16*b* is opened up. As a result, the oil can escape from the cylinder chambers, and the piston 15 of KZE1 can retract again.

The discharge ducts 15*b*, 7*b* of KZE1 are subsequently situated in alignment again, and the outlet valve 2 can close again without opposing pressure from the upper piston 16 of KZE2. This ensures a reliable transition from braking operation into regular engine operation or combustion operation.

The functional sequence, described with regard to FIGS. 3*a* to 3*c* and 4*a* to 4*c*, on the valve bridge 7 repeats with every pass of the cam 4 of the camshaft of the internal combustion engine, as a function of normal engine operation (FIG. 3) or engine braking operation (FIG. 4), and thus ensures a functionally reliable, play-free valve drive for the outlet valve actuation.

LIST OF REFERENCE SIGNS

1 Cylinder head
2 Outlet valve
3 Outlet valve
4 Cam
5 Rocker arm axle
6 Rocker arm
6*a* Cam lever
6*b* Actuating lever
7 Valve bridge
7*a* Cylinder wall
7*b* Discharge duct
8 Pivot axle
9 Axle
10 Roller
11 Hydraulic valve play compensation element HVA
12 Adjusting screw
13 Connecting tappet
14 Counter bracket
15 Piston of the piston-cylinder unit KZE1
15*a* Cutout
15*b* Discharge duct
16 Piston of the piston-cylinder unit KZE2
16*a* Cutout
16*b* Outflow bore
17 Cylinder bore
18 Cylinder bore
19 Pin
20 Bore
21 Readjustment spring
22 Feed bore
23 Ball, check valve
24 Screw
25 Branch duct

The invention claimed is:

1. A device for actuating outlet valves of a valve-controlled internal combustion engine for motor vehicles, the device being part of a valve drive between a cam of a driving camshaft and the outlet valves, the device comprising:

a valve bridge for acting on the outlet valves;

a fixed counter bracket;

a first hydraulically charged piston-cylinder unit having a piston and a pressure chamber, disposed on the valve bridge in a force flow between the cam of the driving camshaft and one of the outlet valves, and configured so that when the one of the outlet valves opens under action of exhaust-gas counter pressure, play compensation in the valve drive can be produced to hold the one of the outlet valves open;

a second piston-cylinder unit having a piston and a pressure chamber arranged on the valve bridge coaxial with the first piston-cylinder unit, the second piston-cylinder unit interacts with the fixed counter bracket to control a discharge duct out of the pressure chambers of the first piston-cylinder unit and the second piston-cylinder unit; and a spring acting on the pistons of the first piston-cylinder unit and the second piston-cylinder unit without being supported in the valve bridge, the spring preloading the piston of the first piston-cylinder unit in a readjustment direction.

2. The device of claim 1, wherein the chambers of the first piston-cylinder unit and the second piston-cylinder unit are connected to one another by a recess or bore in the valve bridge, the spring extending through the recess or bore such that the spring is supported only on the pistons of the first piston-cylinder unit and the second piston-cylinder unit.

3. The device of claim 2, wherein the spring is a helical compression spring.

4. The device of claim 1, wherein the pistons of the first piston-cylinder unit and the second piston-cylinder unit are guided in corresponding cylinder bores with limiting stops, which permit a readjustment movement of the pistons.

5. The device of claim 1, wherein the piston of the first piston-cylinder unit is movable between a retracted position and a deployed position, the discharge duct includes pressure discharge ducts in a cylinder wall and the piston of the first piston-cylinder unit, wherein the pressure discharge ducts are open when the piston of the first piston-cylinder unit is in the retracted position and the pressure discharge ducts are closed when the piston is in the deployed position.

6. The device of claim 5, wherein the piston of the first piston-cylinder unit is in the retracted position during engine operation and is in the deployed position during a braking operation.

7. The device of claim 1, further comprising a hydraulic valve play compensation element in the force flow between the cam of the camshaft and the valve bridge.

8. The device of claim 7, wherein the first piston-cylinder unit, the second piston-cylinder unit, and the hydraulic valve play compensation element are supplied with pressurized oil from a forced-circulation lubrication oil system of the internal combustion engine, the device comprising a pressure-maintaining check valve in a feed line to the first piston-cylinder unit, the second piston-cylinder unit, and the hydraulic valve play compensation element.

9. A vehicle powered by an internal combustion engine including the device of claim 1.

* * * * *